United States Patent [19]

Liechti et al.

[11] 4,155,479

[45] May 22, 1979

[54] CONTAINER OF PLASTIC MATERIAL

[75] Inventors: Rudolf Liechti, Romont; Albert DeMont, Antigny, both of Switzerland

[73] Assignee: Metallurgie et Plastic SA, Romont, Switzerland

[21] Appl. No.: 880,280

[22] Filed: Feb. 22, 1978

Related U.S. Application Data

[63] Continuation of Ser. No. 629,137, Nov. 5, 1975, abandoned.

[30] Foreign Application Priority Data

Nov. 18, 1974 [CH] Switzerland ..... 15307/74

[51] Int. Cl.[2] ..... B65D 21/02

[52] U.S. Cl. ..... 220/23.4; 206/203; 220/90 A

[58] Field of Search ..... 220/23.4, 94 R, 94 A; 206/504, 203

[56] References Cited

U.S. PATENT DOCUMENTS

| | | | |
|---|---|---|---|
| 3,115,281 | 12/1963 | Somme | 220/72 |
| 3,131,829 | 5/1964 | Masser | 206/203 |
| 3,147,151 | 9/1964 | Toce | 220/23.4 |
| 3,184,148 | 5/1965 | Poupitch | 206/203 |
| 3,516,571 | 6/1970 | Roper | 220/72 |
| 3,627,170 | 12/1971 | Pulliam | 220/306 |
| 3,683,549 | 8/1972 | Simmon | 220/23.4 |
| 3,751,098 | 8/1973 | Owen | 220/23.4 |
| 3,815,281 | 6/1974 | Kinder | 220/23.4 |
| 3,862,683 | 1/1975 | Koelichen | 220/23.4 |

FOREIGN PATENT DOCUMENTS

| | | | |
|---|---|---|---|
| 2139548 | 4/1972 | Fed. Rep. of Germany | 220/23.4 |
| 846602 | 8/1960 | United Kingdom | 220/23.4 |

*Primary Examiner*—George E. Lowrance
*Attorney, Agent, or Firm*—Imirie & Smiley

[57] ABSTRACT

A container of plastic material, comprising a truncated body and a cover therefor, and having at least one handle, in which the container also includes a rigid polygonal flange provided on certain of its sides with means operating in such a manner as to eliminate the relative displacement of two or several juxtaposed containers.

9 Claims, 15 Drawing Figures

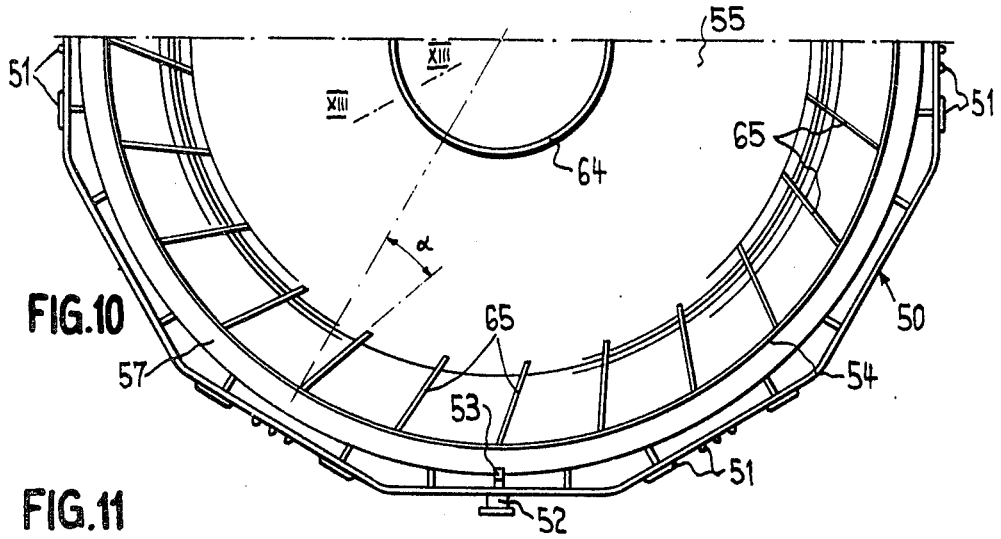
FIG.10
FIG.11
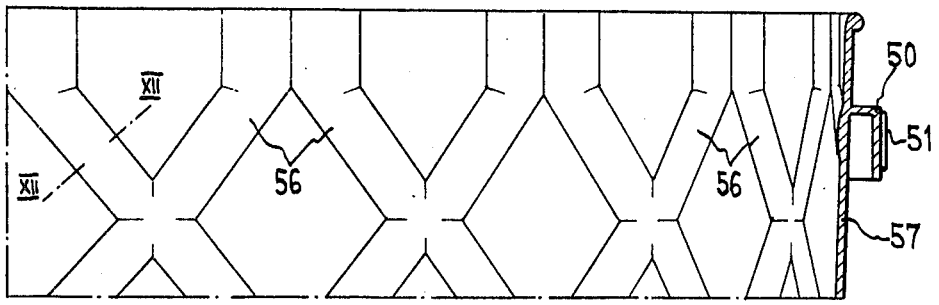
FIG.12
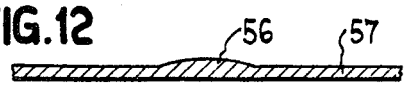
FIG.13
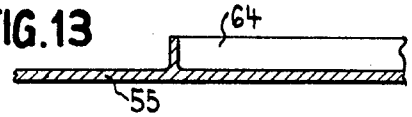
FIG.14
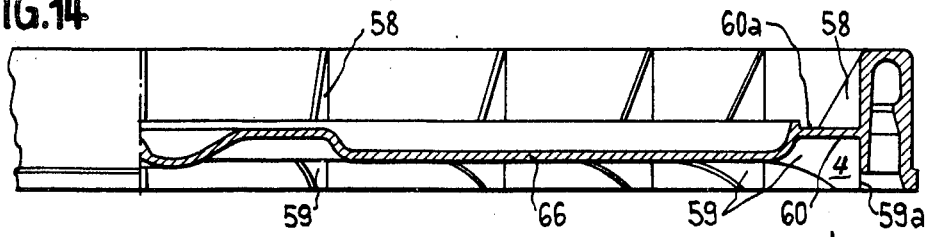
FIG.15
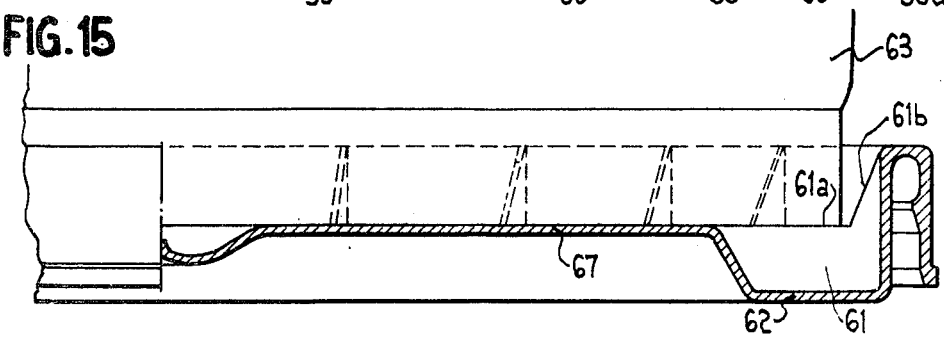

CONTAINER OF PLASTIC MATERIAL

This is a continuation of application Ser. No. 629,137, filed Nov. 5, 1975, now abandond.

The present invention relates to a container of plastic material, provided with a cover and having at least one handle.

Containers made of plastic material have a number of advantages, amongst which may be mentioned, economical manufacture and good resistance to corrosin.

However, the rigidity of such containers generally becomes insufficient when the capacity thereof increases, or, when the mass of the transported material is large; this fault appears, in particular, during transportation when such containers are subjected to lateral forces which tend to deform the body of the container and often cause opening of the cover.

A container is known which comprises a ribbed belt encircling the upper part of the truncated body of the container; moreover, the rigidity of the base is increased by utilising a plurality of suitable located ribs. For carrying or transporting purposes, such containers are placed side by side on standardized pallettes; their ribbed belts are thus only on contact along a line, the length of which corresponds to the height of the belt; thus, if lateral forces do occur, the superficial pressure can be sufficiently large to deform the body of the container and provoke the opening of the cover.

It is an object of the present invention to improve the resistance against shocks of such containers by the provision of a polygonal flange presenting, on certain of its faces, means operating in a manner to eliminate the relative displacement of two or several juxtaposed containers, in particular for transportation purposes.

According to the present invention there is provided a container comprising a truncated body and a cover therefor, and having at least one handle, in which the container also includes a rigid polygonal flange provided on certain of its sides with means operating in such a manner as to eliminate the relative displacement of two or several juxtaposed containers.

Also, and it is another characteristic of the invention, the lower part of the body comprises a relatively flexible deformable surface which is separated from the body but which surrounds the base of the body so as to protect same against lateral forces.

The invention will be further illustrated by way of example, with reference to the accompanying drawings, in which:

FIG. 10 is a partial view, from below, of another embodiment of the container;

FIG. 11 shows a net of ribs which is useful for increasing the rigidity of the body;

FIG. 12 is a sectional view, along the line XII—XII of FIG. 11.

FIG. 13 is a sectional view, along the line XIII—XIII of FIG. 10.

FIG. 14 and FIG. 15 show other embodiments of the cover.

Figure 1:
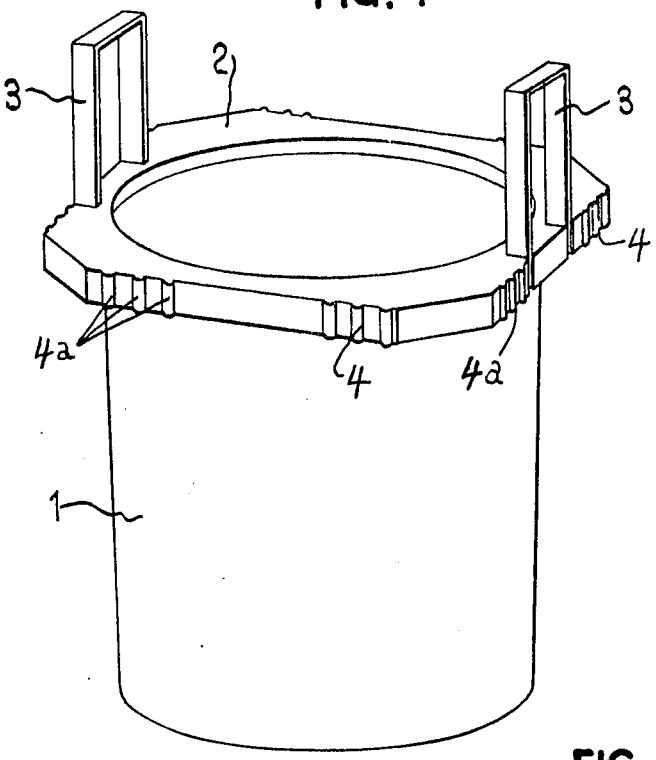
FIG. 1 is a perspective view of a container, without a cover.
Figure 3:
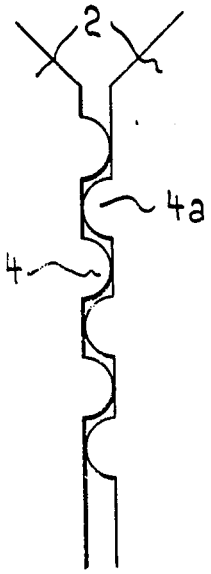
FIG. 3 illustrates the principal of the means operating in a manner to eliminate the relative displacement of the containers.
Figure 2:
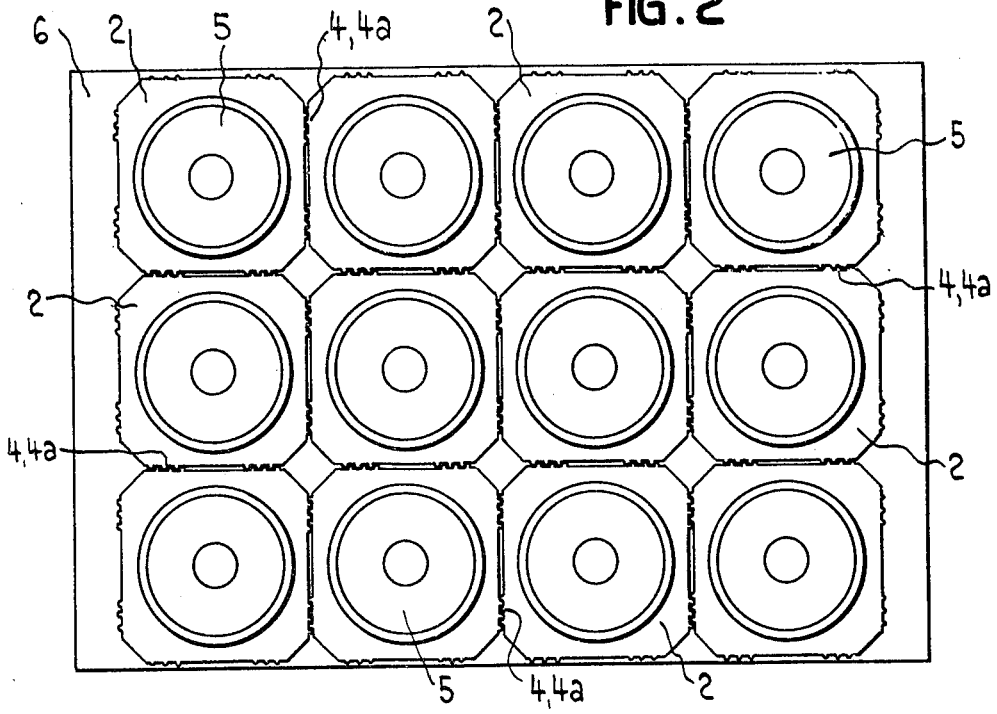
FIG. 2 is a plan view of an assembly of containers disposed on a standardized pallette.
Figure 4:
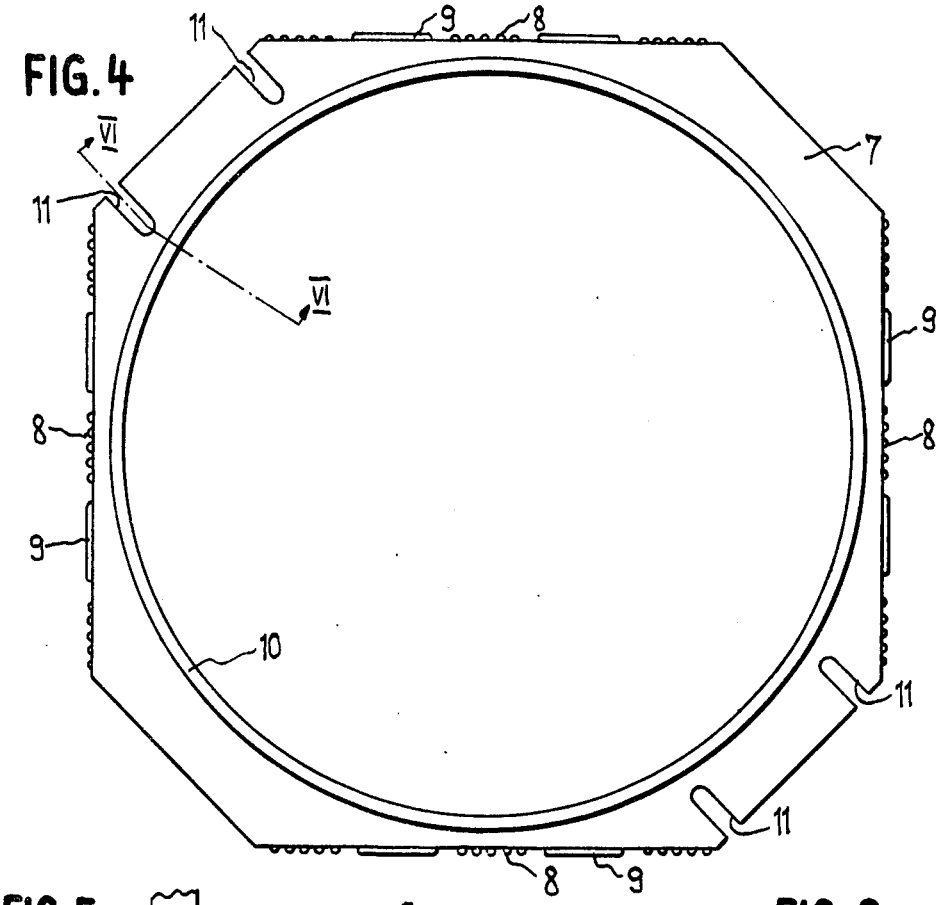
FIG. 4 is a plan view of one embodiment of container in accordance with the invention.
Figure 5:
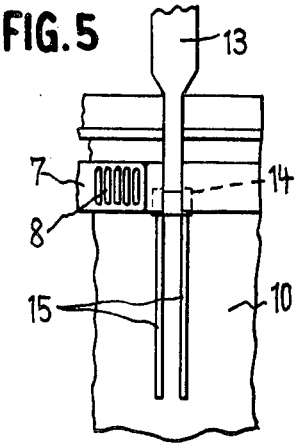
FIG. 5 represents a detail of FIG. 6 (viewed from the left of FIG. 6)
Figure 6:
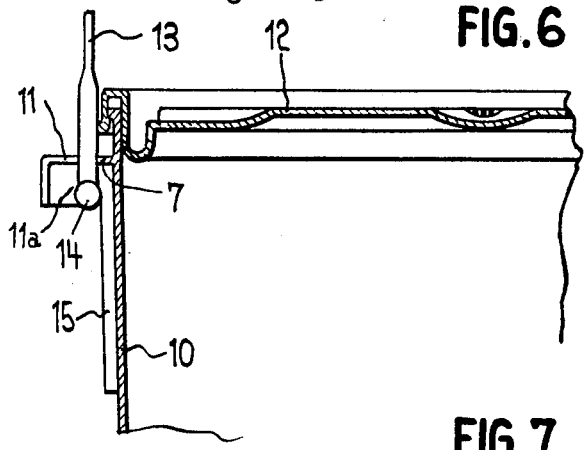
FIG. 6 is a sectional view, along the line VI-VI of FIG. 4, of the container and of the cover which is associated therewith and of a handle.
Figure 7:
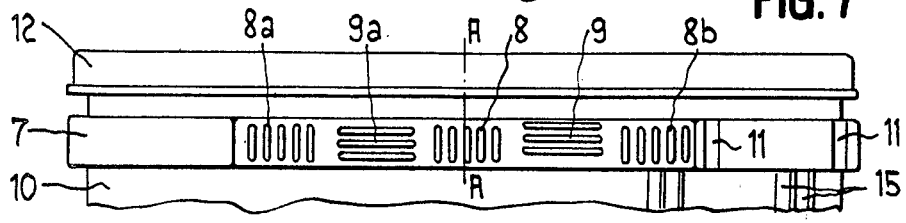
FIG. 7 shows the detail of the means eliminating the relative displacement of the containers.

FIGS. 1, 2 and 3 illustrate the principal idea of the invention; the container comprises a body 1 having a polygonal flange 2; ribs 4*a* are provided on the sides of the flange 2; moreover, openings are made in the flange so that handles 3 can pass therethrough. For transporting, the containers, which are provided with covers 5, are disposed on a pallette 6 (FIG. 2) in a manner so that the ribs 4 are interfitted or embedded in the ribs 4*a* of an adjacent container (FIG. 3). The assembly of containers can then be tied up with a plastic material belt or a thermo-retractable sheet. The ribs eliminate the relative displacement of the containers during transport; moreover, the flanges are sufficiently rigid to avoid the deformation of the body in the case of lateral forces.

The flange can, if desired, be placed at the base of the body or associated with the cover of the container.

FIGS. 4, 5, 6 and 7 show a first variation of the invention; the flange 7, seen in plan, has a square shaped base with angles chamfered at 45°; the section of the flange (see FIG. 6) resembles an angle iron the thickness of which is substantially equal to that of the body 10; one of the edges of the angle iron, perpendicular to the axis of the container, constitutes the upper plane of the flange 7, the other sides thereof.

An assembly of ribs, not shown, connects the sides of the flange to the wall of the body. The flange 7 is disposed in the region of the upper part of the truncated body 1o. Groups of ribs 8, 8*a*, 8*b*, 9, 9*a* (see FIG. 7) are disposed, alternatively, in perpendicular directions; thus these ribs can be embedded within those of an adjacent container; also after a rotation of 180° with respect to the axis A—A (FIG. 7), the ribs of groups 8*b* and 9 can be placed between the ribs of the groups 8*a* and 9*a*. In this manner, when two or several containers are in contact, it is possible to eliminate the relative displacement of the containers in two directions.

Openings 11 are provided on two of the angles, chamfered and opposed, of the flange 7; they permit the passage therethrough of handles 13, provided at their ends with cylinders 14 are housed in a cavity 11*a*, of the flange 7. Supplementary ribs 15 are provided for absorbing the bending stresses of the flange due to the traction exerted on the handles when the container is lifted.

It is clear that the handles 13 can be replaced by a single handle; in this case, only a single opening 11 is provided on each of the opposite angles. The cover 12 (FIG. 6) will be described, in detail, later.

Figure 8:
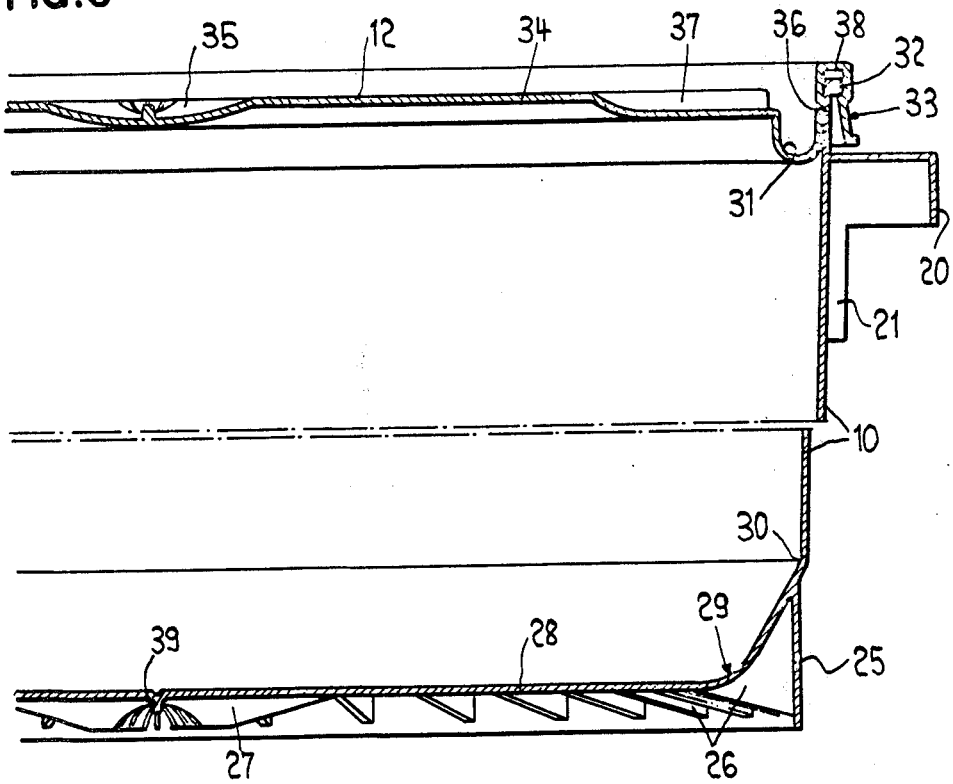
FIG. 8 is a sectional view of another variant of a container in accordance with the invention.

FIGS. 8 and 9 show another embodiment of container; the octagonal flange 20, presents on four of its sides, groups 8 and 9 of ribs similar to those described above; the partial view of FIG. 9 shows the arrangement of the ribs 24 which connect the sides of the flange 20 to the wall of the truncated body 10. On four of the sides of the flange, these ribs are constructed in a manner to be able to hold and easily manipulate the container; the parts 22 and 23 of the flange thus act as a handle; the ribs 21, deliminating the beveled corner parts 22 and 23, are extended along the generatrix of the body for a certain distance.

The wall of the body 10 is extended above the plane of the flange 20, defining a quasi-cylindrical lip 36 permitting the adjusment of the cover 12.

The cover 12 comprises a central part 34, reinforced by ribs 37, connected to the closing device of the cover by a flexible wall 31 in the form of a "U," the wall 31 permits absorption of forces when applying the closing device; this latter is formed of a folded over wall which grips the lip 36 and maintains the cover 12 by the intermediary of the abutment 32. A ribbon, of plastic material, can be placed in the notch 33 so that the cover can be firmly fixed. A suitable joint can be lodged in the annular space 38 in order to ensure the tightness of the cover.

The base 28 of the container is connected to the body 10 by a truncated cone continuously joined by curves 29 and 30. The wall of the body is extended by a cylindrical part 25 surrounding the base 28; regularly spaced ribs 26 reinforce the cylindrical part 25. The cylindrical part 25 can be deformed, when a force occurs, thus protecting the base 28 of the container.

The container and the cover are formed from a plastic material, e.g., high density polyethylene, by injection. In the case of the container, the plastic material is injected in the centre 39 of the base; the conditions of distribution of the material during injection are improved by a series of ribs 27 connecting the injection point and the base of the body; the curves 29 and 30 likewise improve the injection.

Similar considerations apply to the ribs 35 of the cover 12.

FIG. 10 shows, from below, another embodiment of the container in accordance with the invention. The polygonal flange 50 comprises twelve sides, one side out of two being provided with means operating in such a way that the relative displacement of juxtaposed containers is eliminated.

Figure 9:
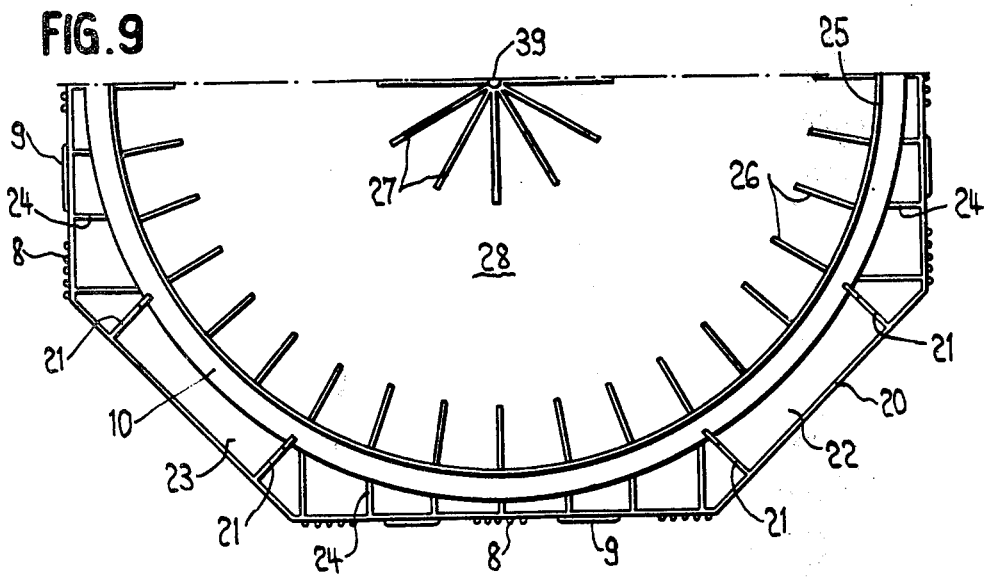
FIG. 9 is a partial view, from below, of the container of FIG. 8.

Two opposite sides of the flange 50 are set with a pin 52, so as to hang up the ends of a flexible handle; the axis of the pin 52 coincides with the ribs 53 (ribs having the same fonction as ribs 21 in FIGS. 8 and 9).

The base 55 of the container also comprises (as previously shown in FIG. 8) a cylindrical part 54 functioning as shock absorber; to improve this absorption, some flexible ribs 65 connect the base 55 to the cylindrical part 54, each rib 65 forming a determined angle $\alpha$ with respect to a radius; during a shock these ribs bend easier than the radial ones.

The central part of the base 55 is provided with a sleeve 64 (see FIG. 13) engagable on a supporting surface such as the surface of the pallette when the container is full.

In order to improve the rigidity of the container, it is possible to provide a net of ribs 56 (see FIGS. 11 and 12) on the inner surface of the wall 57; these ribs have a small height (for instance 0.5 mm) so that to avoid difficulties with the mould.

In certain cases, the cover 66 must be very stiff. The flexible part 31 of the cover 12 as shown in FIG. 8 is replaced by a wall 60 (see FIG. 14) stiffened by a series of ribs 58 and 59. The triangular shaped ribs 58 leave free a part **60*a* of the wall 60 in order to centre another container for stacking. The lower part of the ribs 59 is in the same plane surface of the cover; the part 59*a*** extends the wall of the lip permitting the adjustment of the cover. This arrangement facilitates the pile-up of covers.

Another possibility to reinforce the cover is shown in FIG. 15; the central wall of the cover 67 comprises a kind of groove 62 stiffened by a set of ribs 61. Each rib 61 includes a part **61*a* which extends the central wall and a triangular part 61*b* useful for the stacking of another container 63**.

We claim:

1. A disposable container of injected plastic material comprising body means formed from injection molded plastic material, handle means, and removably attached cover means, said body means including a truncated substantially cylindrical body having a top rim and a base at the bottom thereof and an integral, radially disposed polygonal flange projecting from the top portion of said body spaced below said rim and extending radially outwardly beyond the radial edge of said cover means when attached so as to protect said cover means against lateral forces, said cover means being removably secured to said rim, said flange comprising a substantially horizontally disposed flange portion extending radially from said body and a substantially vertically disposed flange portion integrally attached to and depending from the outer part of said horizontally disposed flange portion, said vertically disposed flange portion having projecting means extending radially outwardly for lockingly interengaging like projecting means on the corresponding vertically disposed flange portion of an adjacent container and thereby for jointly eliminating the relative displacement of juxtaposed containers during transportation, said substantially vertical flange portion being spaced from said body so as to protect said body from contact with an adjacent contact body, said handle means being connected to said flange.

2. A container according to claim 1, wherein said projecting means comprises groups of ribs alternately disposed in perpendicular directions and which interfit with other groups of ribs of an adjacent container.

3. A container according to claim 1, wherein said body comprises at its bottom a deformable skirt connected to said bottom by ribs which form a certain angle with respect to a radius of said truncated body.

4. A container according to claim 1, wherein said cover means is provided with wall means which extends from the plane of said polygonal flange, thus defining a quasi-cylindrical lip, said cover means being locatable on the inside of said lip.

5. A container according to claim 4, wherein said cover means comprises a central part and a closing device and wherein said central part of said cover means is connected to said closing device of said cover means by a flexible "U"-shaped lip.

6. A container according to claim 5, wherein said "U"-shaped lip is stiffened by a series of ribs which extend from said central wall and a triangular part for the centering and the stacking of another container.

7. A container according to claim 1, wherein said polygonal flange is of octagonal form, four of the respectively opposed sides thereof having said projecting locking means thereon and at two opposed intermediate sides having handle means thereon to enable an operator to grasp and easily manipulate the container.

8. A container according to claim 1, wherein said bottom comprises a sleeve engagable with a supporting surface when the container is full.

9. A container according to claim 1, wherein said projecting means comprises rib means.

* * * * *

UNITED STATES PATENT AND TRADEMARK OFFICE

CERTIFICATE OF CORRECTION

PATENT NO. : 4,155,479

DATED : May 22, 1979

INVENTOR(S) : Rudolf Liechti and Albert DeMont

It is certified that error appears in the above-identified patent and that said Letters Patent are hereby corrected as shown below:

On the cover page, in paragraph (75) change the residence of inventor Albert DeMont to read as follows:

-- Autigny, Switzerland --

Signed and Sealed this

*Eleventh* Day of *March 1980*

[SEAL]

*Attest:*

SIDNEY A. DIAMOND

*Attesting Officer*

*Commissioner of Patents and Trademarks*